US011364609B2

(12) United States Patent
Theberath et al.

(10) Patent No.: US 11,364,609 B2
(45) Date of Patent: Jun. 21, 2022

(54) PNEUMATIC NAILER WITH A SAFETY DEVICE

(71) Applicant: Joh. Friedrich Behrens AG, Ahrensburg (DE)

(72) Inventors: Martin Theberath, Tangstedt (DE); Joachim Bauer, Bad Oldesloe (DE)

(73) Assignee: Joh. Friedrich Behrens AG, Ahrensburg (DE)

( * ) Notice: Subject to any disclaimer, the term of this patent is extended or adjusted under 35 U.S.C. 154(b) by 206 days.

(21) Appl. No.: 16/712,491

(22) Filed: Dec. 12, 2019

(65) Prior Publication Data

US 2020/0189078 A1 Jun. 18, 2020

(30) Foreign Application Priority Data

Dec. 12, 2018 (EP) ..... 18212051

(51) Int. Cl.
*B25C 1/00* (2006.01)
*B25C 1/04* (2006.01)

(52) U.S. Cl.
CPC ..... *B25C 1/008* (2013.01); *B25C 1/047* (2013.01)

(58) Field of Classification Search
CPC ..... B25C 1/008; B25C 1/047; B25C 1/043; B25C 1/046; B25C 1/04; B25C 1/06
See application file for complete search history.

(56) References Cited

U.S. PATENT DOCUMENTS

| | | | | |
|---|---|---|---|---|
| 3,964,659 | A | 6/1976 | Eiben et al. | |
| 5,522,532 | A * | 6/1996 | Chen | B25C 1/008 227/130 |
| 2014/0231485 | A1* | 8/2014 | Bauer | B25C 1/008 227/8 |
| 2015/0165611 | A1* | 6/2015 | Puppala | B25C 1/008 227/8 |
| 2016/0114470 | A1 | 4/2016 | Weigmann et al. | |
| 2018/0117748 | A1* | 5/2018 | Ishikawa | B25C 1/046 |
| 2018/0159500 | A1 | 5/2018 | Ishikawa et al. | |
| 2019/0389045 | A1* | 12/2019 | Ishikawa | B25C 1/043 |

FOREIGN PATENT DOCUMENTS

| | | | |
|---|---|---|---|
| DE | 102013106657 | A1 | 1/2015 |
| EP | 2767365 | B1 | 12/2016 |
| WO | 2015/094504 | A1 | 6/2015 |
| WO | 2018/159491 | A1 | 9/2018 |
| WO | 2018/159500 | A1 | 9/2018 |

* cited by examiner

*Primary Examiner* — Anna K Kinsaul
*Assistant Examiner* — Veronica Martin
(74) *Attorney, Agent, or Firm* — Barclay Damon LLP

(57) ABSTRACT

A pneumatic nailer is provided comprising a working piston which is connected to a driving plunger for driving in a fastening means and which is subject to compressed air when a driving-in process is triggered, The nailer also includes a triggering device for initiating a driving-in process, a safety device configured to switch the nailer from a trigger-ready state to a locked state a control valve to control the pressure inside of the control chamber which includes a control valve member which is moveable along an adjustment path and a damper coupled to the control valve member.

14 Claims, 7 Drawing Sheets

PNEUMATIC NAILER WITH A SAFETY DEVICE

CROSS REFERENCE TO RELATED DISCLOSURE

This application is based upon and claims priority to, under relevant sections of 35 U.S.C. § 119, European Patent Application No. 18 212 051.9, filed Dec. 12, 2018, the entire contents of which are hereby incorporated by reference.

TECHNICAL FIELD

The disclosure relates to pneumatic nailers, and more particularly, to a pneumatic nailer having a new and useful safety device which is controlled by pressure in the control chamber of the pneumatic nailer.

BACKGROUND

Safety devices can prevent a pneumatic nailer from unintentionally carrying out a driving-in operation, as explained below, using the example of a pneumatic nailer with a contact feeler. When a pneumatic nailer is applied to a workpiece, the contact feeler is displaced against the force of a spring until a muzzle tool rests or almost rests against the workpiece. A driving-in process can only be triggered if the contact feeler is actuated in this way. Some pneumatic nailers with contact feelers can be used in two different operating modes: With the so-called single release, the pneumatic nailer is first applied to a workpiece and the contact feeler is thus actuated. A trigger for the pneumatic nailer is then manually actuated, triggering a single driving-in process. With the so-called contact triggering, also known as "touching", the user already holds the trigger pressed while he places the pneumatic nailer onto the workpiece. When pressing the contact feeler against the workpiece, it is actuated and a driving process is triggered. The pneumatic nailer can be applied repeatedly and in rapid succession, which enables very fast work, especially if a large number of fasteners have to be driven in for sufficient fastening and the positioning accuracy is subject to only minor requirements.

In certain situations, however, the contact triggering method increases the risk of injury. If, for example, the user holds down the manually operated trigger not only when he wants to place the pneumatic nailer on the same workpiece at a distance of a few centimetres from the last fastener driven in, but also when he switches to another, remotely located workpiece, a driving-in process can be triggered if an object or body part is accidentally touched by the contact feeler. For example, accidents can occur if a user (in violation of important safety regulations) climbs onto a ladder with the pneumatic nailer, keeps the trigger pressed and inadvertently touches his leg with the contact feeler.

Some known pneumatic nailers try to reduce this risk associated with contact triggering by means of a safety device that allows contact triggering only for a short period of time after the trigger has been actuated or after a driving-in process. Once the time period has elapsed, the trigger must first be released.

An example of this is given in EP 2 767 365 B1. The pneumatic nailer described therein has a trigger and a contact feeler, each of which is assigned a control valve. In addition, the familiar device has a safety device with a control chamber whose pressure acts on a blocking piston. In a certain position of the locking piston, the triggering of a driving-in process is inhibited. The control chamber is aerated via the control valve assigned to the trigger and a throttle. After actuation of the trigger, contact triggering is only possible until the pressure in the control chamber exceeds a specified pressure threshold. The pneumatic nailer is then locked until the trigger is released and the pressure in the control chamber has fallen below the pressure threshold again.

A similar functionality is offered by the pneumatic nailer known from the U.S. Pat. No. 3,964,659, which can also be used in single and contact triggering mode and in which a trigger and a contact feeler are mechanically coupled via a rocker. The rocker acts on a control valve to trigger a driving-in process by deaerating a main control line. If only the trigger is actuated and not the contact feeler, a control pin of the control valve is only displaced over part of its adjustment travel. This partial actuation of the control valve leads to slow aeration of a control chamber via a small aeration opening. The pressure prevailing in the control chamber acts on a valve sleeve surrounding the control valve and eventually moves the valve sleeve to a blocking position where complete actuation of the valve pin can no longer deaerate the main control line, preventing contact triggering.

From the document DE 10 2013 106 657 A1 a pneumatic nailer with a safety device has also become known, which in an exemplary embodiment has a small piston which changes the position of a rocker integrated in a trigger device. The piston is subjected to pressure in a control chamber and displaced against the force of a spring. In an alternative embodiment, the safety device has a sleeve arranged around a valve pin which can be displaced against the force of a spring. The position of the sleeve is also controlled by the pressure in a control chamber. In both cases, the triggering of a driving-in process is prevented when the piston or sleeve is in a certain position. The control chamber is aerated from the working volume during each driving-in process and then slowly deaerated via a small vent opening.

A common feature of the discussed examples from the state of the art is that the evolution of the pressure over time in the control chamber is significantly influenced by a gradual deaeration or aeration through a throttle or other small opening. The time control of the safety device achieved in this way depends on the cross-section of the opening used. Particularly in connection with small control chambers, relatively small opening cross-sections must be used, which makes the known solutions complex in their construction and sensitive to dirt.

From the publication WO 2015/094504 A1 a pneumatic nailer has become known, which can be used in a contact triggering mode. A triggering device of said pneumatic nailer comprises a contact feeler and a trigger, in which a rocker is pivotably hinged. In contact triggering mode, when the pneumatic nailer is applied to a workpiece the contact feeler moves upwards and takes a free end of the rocker with it, so that when the trigger is actuated a control valve is actuated by the rocker, which triggers a driving-in process. A downward movement of the rocker is slowed down by a damper in such a way that further contact triggering is possible within a specified period of time. After the period of time has elapsed, the free end of the rocker has moved so far back down that it is missed by the contact feeler when the pneumatic nailer is placed on a workpiece again. Further triggering is only possible after the trigger has been released. This well-known safety device does not have a control chamber.

From the publication WO 2018/159491 A1 a pneumatic nailer has become known, which has a trigger valve, which is controlled by a trigger and a contact feeler. A damper influences the rotation of a lever which, in a locked position reached after a certain time after the trigger has been actuated, blocks an upward movement of the contact feeler. A safety device controlled by a pressure in a control chamber does not exist in this case.

From the publication WO 2018/159500 A1 a pneumatic nailer has become known, which as in the aforementioned publication is provided with a lever, which blocks an upward movement of a contact feeler. The rotational position of the lever is not influenced by a damper, but by an electrically operated actuator. Neither a pressure-controlled safety device nor a damper is provided in this case.

From the publication US 2018/0117748 A1 a pneumatic nailer has become known, which has a selector switch on the housing, which can be used to switch between two operating modes. Single triggering is possible in the first operating mode. For this purpose, a contact feeler must first be actuated, followed by a trigger. In the second operating mode, the positions of the contact feeler and the trigger are detected with sensors. An electronic controller evaluates a time interval between signals from the two sensors. If the time difference is less than a preset value TO, a magnetic valve is activated, which leads to the extension of a piston rod which actuates a trigger valve. Neither a pressure-controlled safety device nor a damper is implemented.

Proceeding therefrom, it is the objective of the disclosure to provide a pneumatic nailer with a simple and robust safety device.

BRIEF SUMMARY OF THE DISCLOSURE

A pneumatic nailer is provided comprising a working piston which is connected to a driving plunger for driving in a fastening means and which is subject to compressed air when a driving-in process is triggered, The nailer also includes a triggering device for initiating a driving-in process, a safety device configured to switch the nailer from a trigger-ready state to a locked state a control valve to control the pressure inside of the control chamber which includes a control valve member which is moveable along an adjustment path and a damper coupled to the control valve member. The pneumatic nailer is used to drive in fasteners such as nails, pins or staples. For this purpose, the pneumatic nailer may be equipped with a magazine for the fasteners, from which one fastener at a time is fed to a receptacle of a mouth tool of the pneumatic nailer. When a driving-in process is triggered, compressed air is applied to a working piston of the pneumatic nailer. This causes the working piston to drive a driving ram which is connected to the working piston. The driving ram hits a rear end of the fastener in the holder of the mouth tool and drives the fastener into the workpiece.

In particular, the triggering device may have a manually operated trigger, for example, in the form of a trigger lever or slide. The triggering device may comprise one or more control valves actuated by the trigger and, optionally, by other elements of the triggering device, such as a contact feeler and/or a transmission device coupled thereto and/or to the trigger. When the triggering device is properly actuated, a driving-in process is triggered, provided that the pneumatic nailer is in its trigger-ready state. If, on the other hand, the pneumatic nailer is in its locked state, it is not possible to trigger a driving-in process by actuating the release mechanism.

The pneumatic nailer comprises a safety device which is designed to move the pneumatic nailer from the trigger-ready state to the secured state. An example of this change of state is resetting the pneumatic nailer from a contact trigger mode to a single trigger mode. Another example could be a switching off of the pneumatic nailer, which requires a renewed activation of the pneumatic nailer for a further driving-in process, for example by pressing a reset button. In order to switch off the pneumatic nailer, it could, for example, be completely deaerated.

As in the case of the safety devices discussed above in the state of the art, the disclosure also has a control chamber which controls the safety device. For example, the safety device can be designed in such a way that it moves the pneumatic nailer from the trigger-ready state to the secured state when the pressure in the control chamber passes a specified pressure threshold, i.e. when it either exceeds or falls below this pressure threshold. In contrast to known solutions, however, the pressure in the control chamber is not or at least not significantly dependent on a gradual inflow or outflow of air through a throttle or the like. Instead, the pressure in the control chamber is controlled by a control valve, whose control valve member is movable along an adjustment path and coupled to a damper.

Through this coupling, the damper influences the time-dependent movement of the control valve member. With the aid of the control valve, the control chamber can be aerated or deaerated, for example, when the control valve member reaches a predetermined position (hereinafter also referred to as the first switching point) along the adjustment path. In particular, the damper can be adjusted to the control valve and the sequences of certain work steps in such a way that this preset position is reached after a preset period of time has elapsed. The preset time period can begin with a specific event, for example with the actuation of a trigger and/or a touchdown sensor and/or a drive-in process.

The damper is a mechanical component that dampens a movement in a certain direction by opposing the movement with a counterforce acting in the opposite direction. This counterforce can depend on the speed of the movement; in particular it can be substantially proportional to the speed of the movement. The movement damped by the damper can be generated by a force exerted, for example, by a spring or pneumatically. Suitable dampers are available in a wide variety of designs. They can be integrated into the pneumatic nailer in a variety of ways. For the inventive purpose, it is only important that the movement of the control valve member is influenced in the desired way, i.e. in such a way that the pressure in the control chamber is controlled in such a way that the safety device reliably moves the pneumatic nailer from the trigger-ready to the secured state in a potentially dangerous situation.

A particular advantage of the disclosure compared to established pneumatic nailers with a control chamber is that the pressure in the control chamber can be controlled without a throttle or any other, comparably small opening cross-section. This makes the pneumatic nailer less susceptible to accumulation of dirt, which can often hardly be avoided in rough practical use. In addition, the pressure in the control chamber may be brought to a value required for the proper functioning of the safety device much more quickly using the control valve provided for this purpose, which can also improve the reliability of the safety device.

In an embodiment, the damper is coupled to the control valve member in such a way that it slows down movement of the control valve member along at least one section of the adjustment path. The desired time control is achieved by this deceleration of the movement.

In an embodiment, the release mechanism has a contact feeler which is designed to move the control valve member to a fully actuated position when the pneumatic nailer is placed against a workpiece. The contact feeler may be a mechanical component that projects beyond the front end of a mouth tool and is held in this position by a spring, for example, until the pneumatic nailer is placed against a workpiece. Then the contact feeler is moved against the driving direction until a mouth tool of the pneumatic nailer rests against the workpiece or almost rests against it. The contact sensor acts directly or indirectly on the control valve member so that the control valve member is also in a fully actuated position when the contact feeler is in this fully actuated position. In particular, the pneumatic nailer can be designed in such a way that this impact of the contact feeler on the control valve member occurs independently of the position of a trigger. In addition, the contact feeler can perform other functions, such as triggering successive driving-in processes in a contact triggering mode. These additional functions can generally be performed using a separate control valve that interacts with the contact feeler. However, as will become clear from the example of the embodiments explained below, the various functions can be fulfilled in particular by means of a control valve arrangement in which the control valve which controls the pressure in the control chamber is integrated. In any case, the embodiment of the disclosure with a contact feeler is characterized by the fact that the control valve, which controls the pressure in the control chamber, is easily and reliably moved to a defined position when the contact feeler is actuated. In particular, the control valve member can remain in this defined position until the pneumatic nailer is removed from the workpiece.

In an embodiment, the control valve member has a first switching point at which the control valve aerates or vents the control chamber, and the damper is coupled to the control valve member such that, after removal of the pneumatic nailer from a workpiece, the control valve member reaches the first switching point emanating from the fully actuated position after a predetermined period of time has elapsed. In this aspect, the safety device moves the pneumatic nailer from the trigger-ready state to the locked state after the specified time has elapsed. Within the specified time period, the pneumatic nailer remains in the trigger-ready state so that, if the pneumatic nailer is configured for this purpose, contact triggering is enabled.

In an embodiment, the pneumatic nailer has a main control line which must be aerated or deaerated in order to initiate a driving-in process, and the control valve member has a second switching point at which the control valve deaerates or aerates the main control line. A driving-in process can be initiated in different ways using the main control line. A known example is a version with a main valve and a pilot valve which is controlled via the main control line. However, other designs with or without pilot valve are also conceivable. For the elaborated aspect of the disclosure described here, the only requirement is that the driving-in process is triggered by aeration or deaeration of the main control line. This design usually requires that the main control line is deaerated (if the main control line is to be aerated in order to trigger a driving-in process) or that the main control line is aerated (if the main control line is to be deaerated in order to trigger a driving process) before another driving process can be triggered. This condition is fulfilled as soon as the control valve member reaches its second switching point. The second switching point can be reached very quickly starting from the fully actuated position of the control valve member, for example when the pneumatic nailer has been moved 1 mm away from a workpiece and the contact sensor is still close to its fully actuated position. In particular, the second switching point can be reached well before the first switching point, starting from the fully actuated position of the control valve member. This allows a high frequency of driving-in processes to be attained, especially in contact triggering mode.

In an embodiment, the damper is designed and coupled to the control valve member such that it does not dampen movement of the control valve member from the fully actuated position to the second switching point. This measure does not delay the damper's reaching of the second switching point, which also allows contact triggering in rapid succession.

In an embodiment, a mounting of the damper has a slot hole, so that a relative movement of two components connected via the damper over a section of a possible range of motion is not damped by the damper. Such a slot hole is a simple design solution to achieve undamped motion in a range of motion defined by the slot hole.

In an embodiment, a damping effect of the damper is limited to one of two possible directions of movement of the damper. For example, the damper can be designed in such a way that it is not acting if the control valve member is moved to a fully actuated position. It then only dampens the backward movement of the control valve member, which is important for the desired time-dependent behavior. In the other direction of motion, a simple displacement of the control valve member is possible, which enables a smooth movement sequence and avoids unnecessary wear.

In an embodiment, the damper comprises two elements movable relative to each other, the relative movement of which it dampens, one of the two elements being fixed and/or hinged to a part of the pneumatic nailer fixed to the housing, and the other of the two elements being fixed and/or hinged to the contact feeler, to the control valve member or to a force transmission device designed to transmit a force from the contact feeler to the control valve member. The three variants of this configuration concern different constructive solutions for the integration of the damper into the pneumatic nailer. In the first variant, the damper dampens the relative movement between the contact feeler and the housing of the pneumatic nailer. The relative movement of the contact feeler in relation to the housing is essentially linear and over a defined, relatively long distance. The desired damping of the relative movement is therefore particularly simple and robust. In the second variant, the damper dampens the relative movement between the control valve member and the housing of the pneumatic nailer. In contrast to the previous variant, the damper therefore acts directly on the control valve member. Such a direct damping of the movement of the control valve member can be particularly compact. In the third variant, the damper dampens the relative movement between a force transmission device and the housing of the pneumatic nailer. The force transmission device can, for example, be a rocker or a lever which is coupled to the contact feeler in order to act on the control valve member. This variant also allows effective integration of a damper in a compact design.

In an embodiment, the damper is a linear damper or a rotary damper. Both designs are suitable for the disclosure and are available in different versions.

In an embodiment, the damper is a fluid damper or a friction damper. In a fluid damper the damping is achieved by the flow resistance of a gas or a liquid, in a friction damper by the friction between two solids. Both mechanisms are suitable for the disclosure and are available in different versions.

In an embodiment, the safety device has a safety actuator which is switchable between an actuation position, in which actuation of the triggering device can initiate a driving-in process, and a safety position, in which actuation of the triggering device cannot initiate a driving-in process, wherein the pressure in the control chamber exerts a force on the safety actuator. An additional counterforce acting on the safety actuator may also be generated pneumatically and/or by a spring. In particular, the safety actuator may be designed to intervene in a triggering or driving-in process in the safety position in such a way that proper actuation of the triggering device does not trigger a driving-in process.

In an embodiment, the safety actuator is moved from the actuatable position to the safety position when the pressure in the control chamber passes a predetermined pressure threshold. If the pressure in the control chamber is equal to the specified pressure threshold, the force exerted by the pressure in the control chamber may be in equilibrium with a counterforce applied to the safety actuator in some other way.

BRIEF DESCRIPTION OF THE DRAWINGS

The disclosure is described in more detail hereinafter with reference to an exemplary embodiment shown in seven figures, in which.

DETAILED DESCRIPTION OF THE DISCLOSURE

Figure 1:
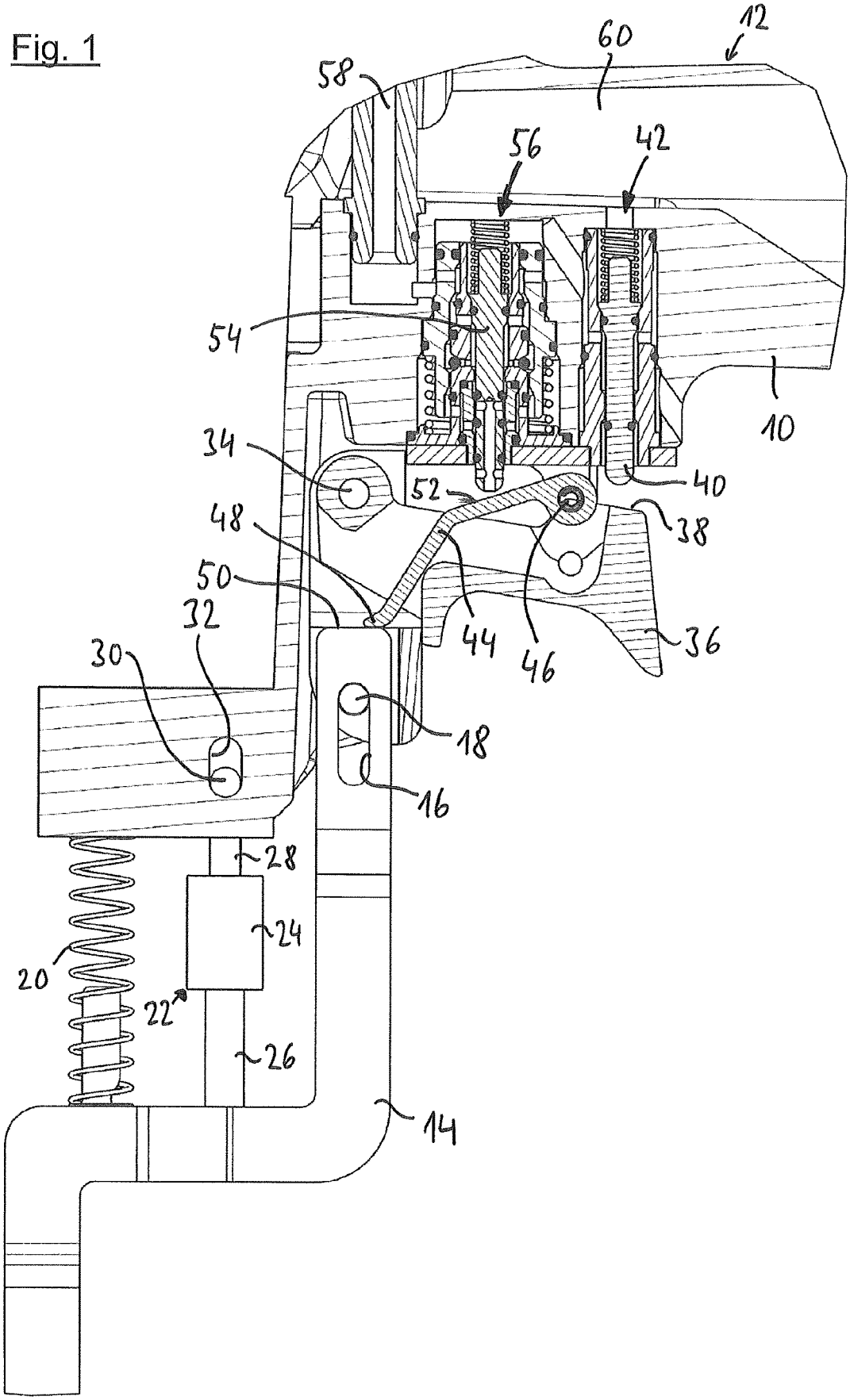
FIG. 1 depict a pneumatic nailer according to the disclosure in a schematic cross-sectional view.

The pneumatic nailer, of which only a section is shown in FIG. 1, has a pneumatic connection and a working cylinder in which a working piston connected to a driving ram is slidably guided. The working cylinder is closed at the top by a main valve which is actuated by a pilot valve. As far as now and in the following the directions above and below are used, these refer to the normal working position of the pneumatic nailer, where the pneumatic nailer is placed on a workpiece with a horizontal surface. A magazine is used to hold a supply of fasteners, especially nails or staples, and ends at the front of a mouth tool into which individual fasteners are inserted. These are then driven into a workpiece by the driving ram when compressed air is applied to the working piston, controlled via the main valve and the pilot valve. These elements of the pneumatic nailer essentially correspond to the state of the art and can, for example, be designed as described in detail in EP 3 257 633 B1 using FIGS. 1 and 2.

FIG. 1, on the other hand, shows a section of a housing 10, which forms a handle 12 which is also partially depicted. A contact feeler 14 is slidably guided in a vertical direction on the housing 10, whereby a lower end of the contact feeler 14, not shown in FIG. 1, protrudes in its lower position above the mouth tool in a manner known from the state of the art. In this lower position, which is shown in FIG. 1, the pneumatic nailer is not applied to a workpiece. At its upper end, the probe 14 has a slot hole 16 with a pin 18 attached to the housing 10. From the position of this pin 18 in the slot hole 16, it is clearly visible in all figures in which position the contact feeler 14 is currently located.

A spring 20 is arranged between the housing 10 and the contact feeler 14, which presses the contact feeler 14 downwards. In addition, a damper 22 is arranged between housing 10 and contact feeler 14, which in the example shown has a cylindrical damper housing 24 in which a damper ram 26 is displaceably guided. The damper ram 26 protrudes from the lower end of the damper housing 24 and is attached at its free end to the contact feeler 14. At the opposite, upper end, the damper 22 has a mounting section 28, which is firmly connected to the damper housing 24. The upper free end of this mounting section 28 is hinged with a horizontally arranged pin 30 to a slot hole 32 formed in the housing 10. The length of the slot hole 32 is smaller than the length of the slot hole 16, in the shown example about half as long.

The damper 22 is designed so that it dampens a movement of the damper ram 26 downwards, i.e. out of the damper housing 24, but not a movement in the opposite direction, i.e. into the damper housing 24. This means that when the pneumatic nailer is applied to a workpiece, the contact feeler 14 can be moved upwards essentially uninfluenced by the damper 22. After removing the pneumatic nailer from a workpiece, the combined effect of the spring 20 and the damper 22 determines the speed at which the contact feeler 14 moves downwards again when the pin 30 rests against the lower end of the slot hole 32 and has to be pulled out of the damper housing 24 for the further downward movement of the damper ram 26.

A trigger device of the pneumatic nailer comprises a trigger 36 pivotally mounted at its front end about a horizontal axis 34. The trigger 36 has an actuating surface 38 for actuating a valve pin 40 of a trigger valve 42. Furthermore, the triggering device comprises a force transmission element in the form of a lever 44 which is pivotally mounted at its rear end about an axis 46 arranged horizontally and fixed to the housing. The free end 48 of the lever 44 rests against an upper surface 50 of the contact feeler 14. An actuating surface 52 arranged on the upper side of the lever 44 serves to actuate a control valve member 54 in the form of a valve pin of a control valve 56. As will be explained in more detail in the other figures, proper actuation of the contact feeler 14 and trigger 36 triggers a driving-in process by pressurizing a main control line 58 via the trigger valve 42 and the control valve 56 with compressed air from a aerated housing interior 60.

Figure 2:
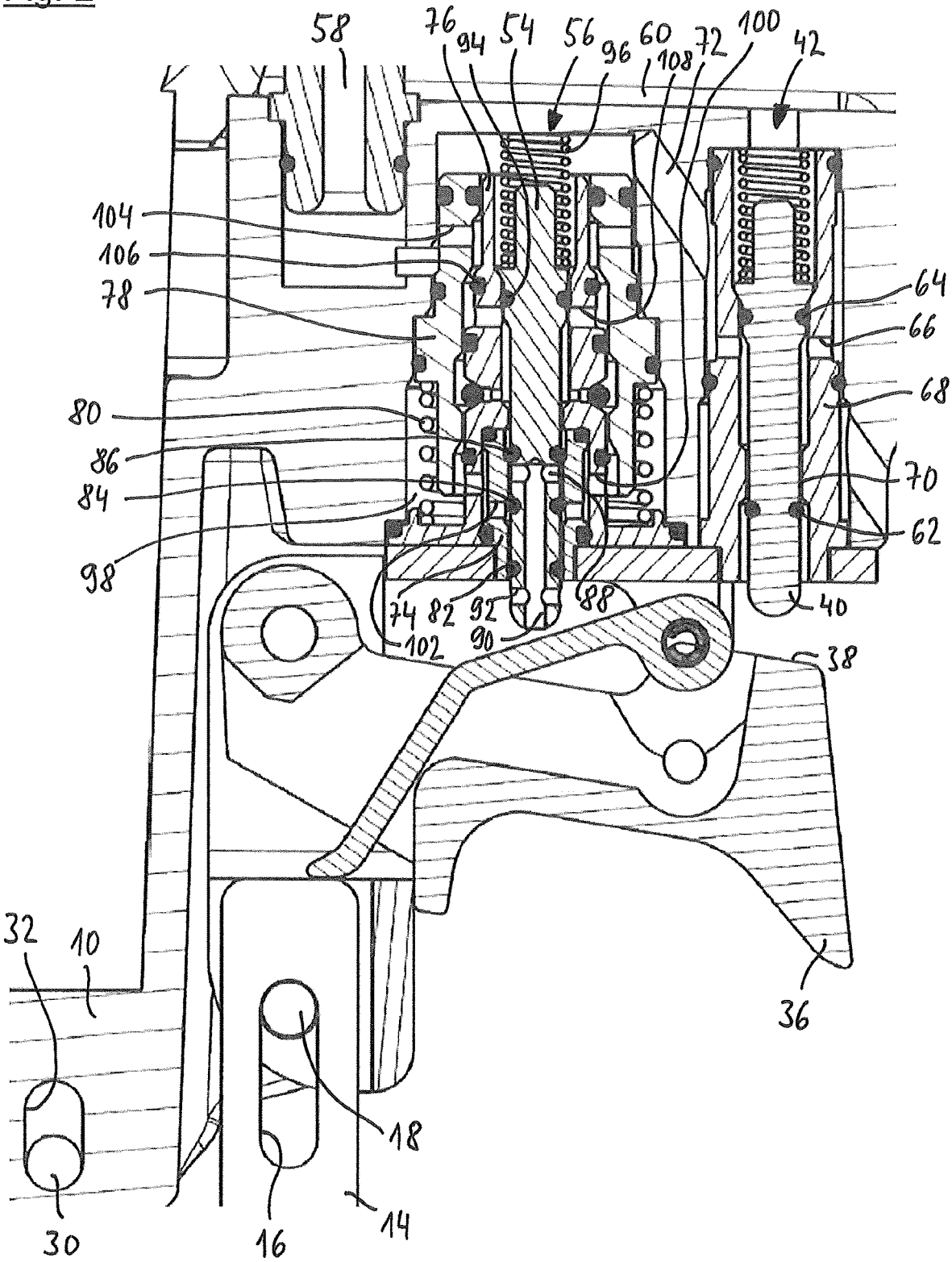
FIGS. 2 to 7 depict enlarged cross-sectional views of various operational views of the pneumatic nailer.

FIG. 2 shows an enlarged section from FIG. 1. The contact feeler 14 is still in its lower end position and the trigger 36 is not actuated. The control valve member 54, which moves along an adjustment path, is also in a lower end position, which corresponds to a completely unactuated position of the control valve 56. The valve pin 40 of the trigger valve 42 is also not actuated. It has a lower O-ring 62 which is not located in the seal and an upper O-ring 64 which is located in the seal.

In this position, a transverse hole 66, located in a sleeve 68 of the trigger valve 42, is connected to outside air via an annular gap 70 and past the lower O-ring 62. The line 72 between trigger valve 42 and control valve 56, which is connected to the transverse hole 66, is therefore deaerated. At the same time, the aerated housing interior 60 is shut off from the transverse hole 66 and the line 72 by the upper O-ring 64 located in the seal.

The control valve member 54 is movably guided in a two-piece sleeve fixed to the housing with an inner sleeve part 74 and an outer sleeve part 76. The outer sleeve part 76 is surrounded by a safety actuator 78, which is also sleeve-shaped. The safety actuator 78 is mounted in the housing 10 so that it can be displaced in the vertical direction. It is pressed by a spring 80 into its upper end position shown in FIG. 2, which corresponds to a trigger-ready state of the pneumatic nailer.

The safety actuator 54 has four O-rings: A first O-ring 82 seals the inner sleeve part 74 from the control valve 54 in any position. Between a second O-ring 84 and a third O-ring 86, both of which are not in the seal, ends a transverse hole 88 in the control valve member 54, which is connected via a longitudinal hole 90 in the control valve member 54 and another transverse hole 92 in the control valve member 54 to external air. A fourth O-ring 94 is located in FIG. 2 in the seal. The control valve member 54 is pressed into its lower end position by a spring 96.

A control chamber 98 is arranged below the safety actuator 78. A pressure prevailing in this control chamber 98, like the spring 80, exerts a force upwards on the safety actuator 78. In the drawn position, the control chamber 98 is connected to outside air via a transverse hole 100 in the outer sleeve part 76 and a transverse hole 102 in the inner sleeve part 74 past the second O-ring 84 via holes 88, 90, 92 in the safety actuator 54.

The main control line 58 is also deaerated via a transverse hole 104 in the safety actuator 78, past a O-ring 106 which is not in the seal and which is arranged between the outer sleeve part 76 and the safety actuator 78, a transverse hole 108 in the outer sleeve part 76 and past the third O-ring 86 through the holes 88, 90, 92 in the control valve member 54.

Figure 3:
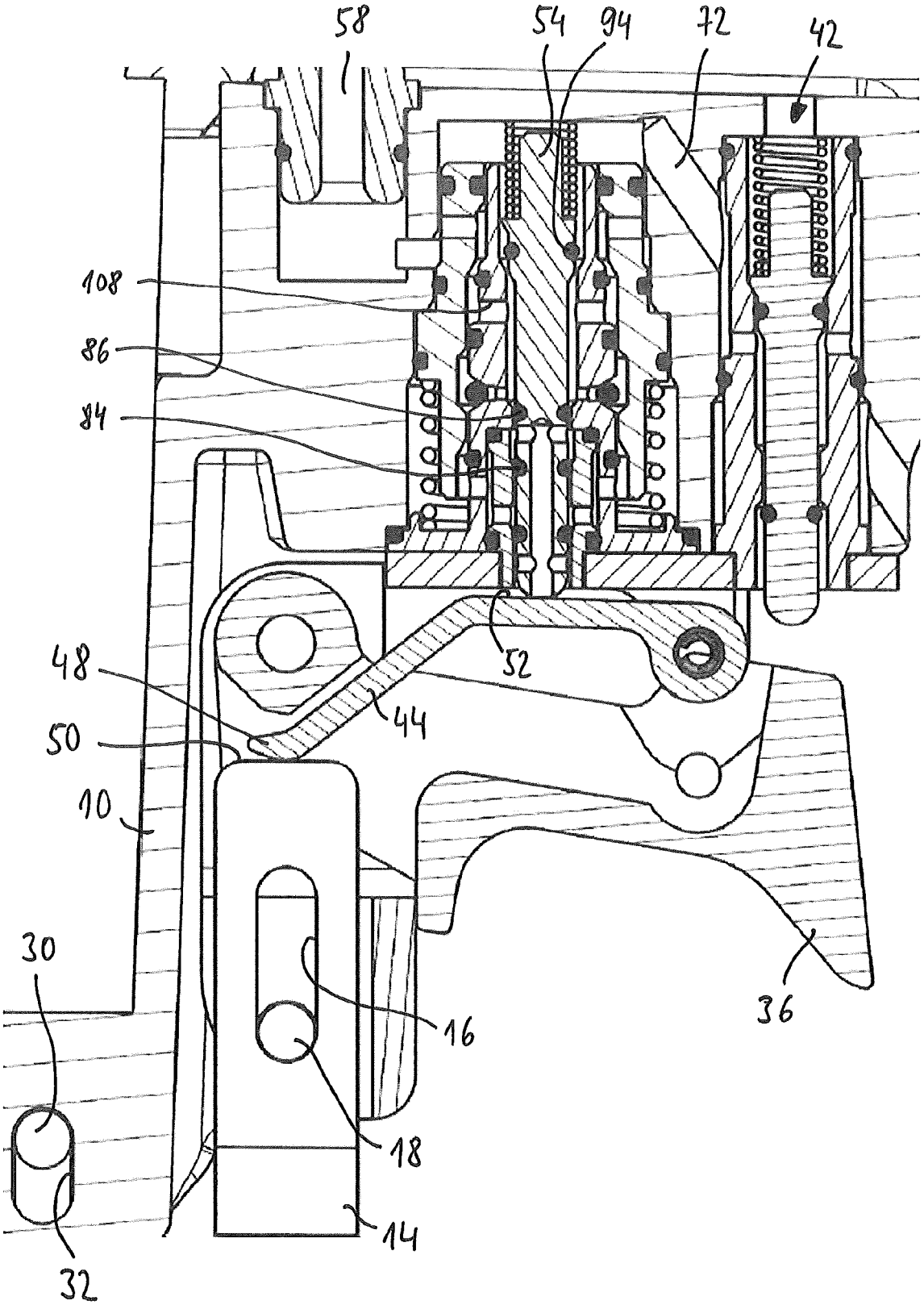

In FIG. 3, the pneumatic nailer is positioned on a workpiece, whereby the contact feeler 14 has reached its upper end position. The pin 18 is therefore located at the lower end of the slot hole 16. During the upward movement of the contact feeler 14 relative to the housing 10, the spring 20 and the damper 22 (only shown in FIG. 1) were pressed together. The damper ram 26 has been pushed a little into the damper housing 24, whereby it may have reached an upper end position inside the damper housing 24. In addition, together with the damper housing 24, the mounting section 28 was pushed upwards so far that the pin 30 now rests against the upper end of the slot hole 32.

On its way up, the upper surface 50 of the contact feeler 14 has taken the free end 48 of the lever 44 with it, so that the actuating surface 52 has shifted the control valve member 54 to its fully actuated position. In this position, the second O-ring 84 and the third O-ring 86 are now in seal so that there is no connection between the holes 88, 90, 92 (see FIG. 2) in the control valve member 54 and the transverse holes 108, 104 and the ring gap between them. At the same time, the fourth O-ring 94 has moved out of the seal so that the line 72 is now connected to the main control line 58 via the transverse hole 108. Since the line 72 is still connected to the outside air via the trigger valve 42, this does not yet trigger a driving-in process.

If the trigger 36 is subsequently actuated, the result is the position shown in FIG. 4. The valve pin 40 has been moved upwards and is now in a fully actuated position where the lower O-ring 62 is in the seal and the upper O-ring 64 has moved out of the seal. Thus the line 72 is aerated past the upper O-ring 64 via the transverse hole 66 from the housing interior 60. The control chamber 98 is also aerated, from line 72 past the fourth O-ring 94, through a transverse bore 110 in the outer sleeve part 76, which forms a check valve with another O-ring 112, and through an annular gap 114 between the outer sleeve part 76 and the safety actuator 78. The force exerted by the pressure in the control chamber 98 and the spring 80 on the safety actuator 78 is so great that it outweighs the force exerted by the pressure in the space 116 above the safety actuator 78 that the safety actuator 78 initially remains in its upper end position. This upper end position of the safety actuator 78 can also be referred to as the trigger position.

Figure 4:
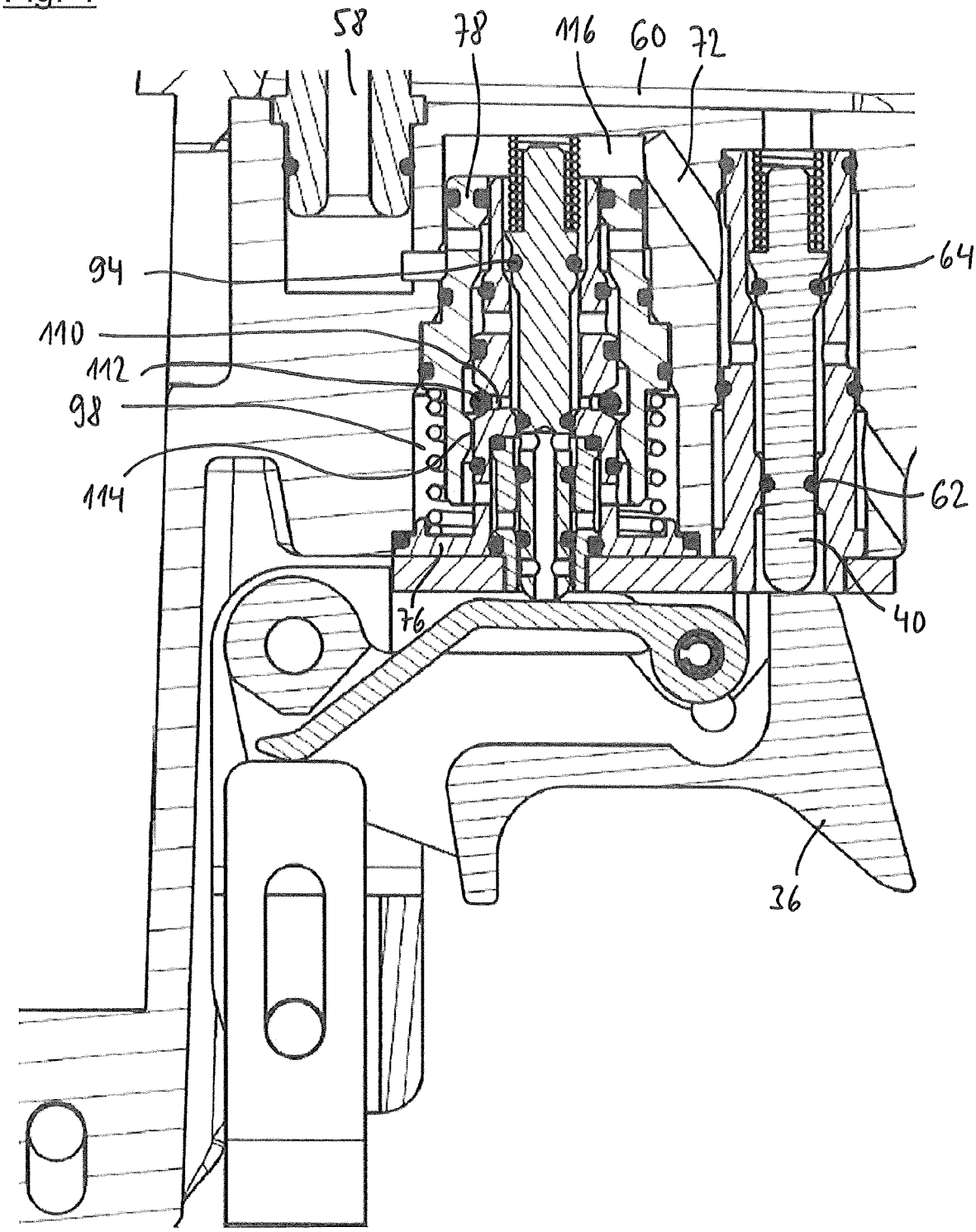

Furthermore, in the position of FIG. 4 there is a connection between line 72 and main control line 58, so that when line 72 is aerated a driving-in process is triggered at the same time.

Figure 5:
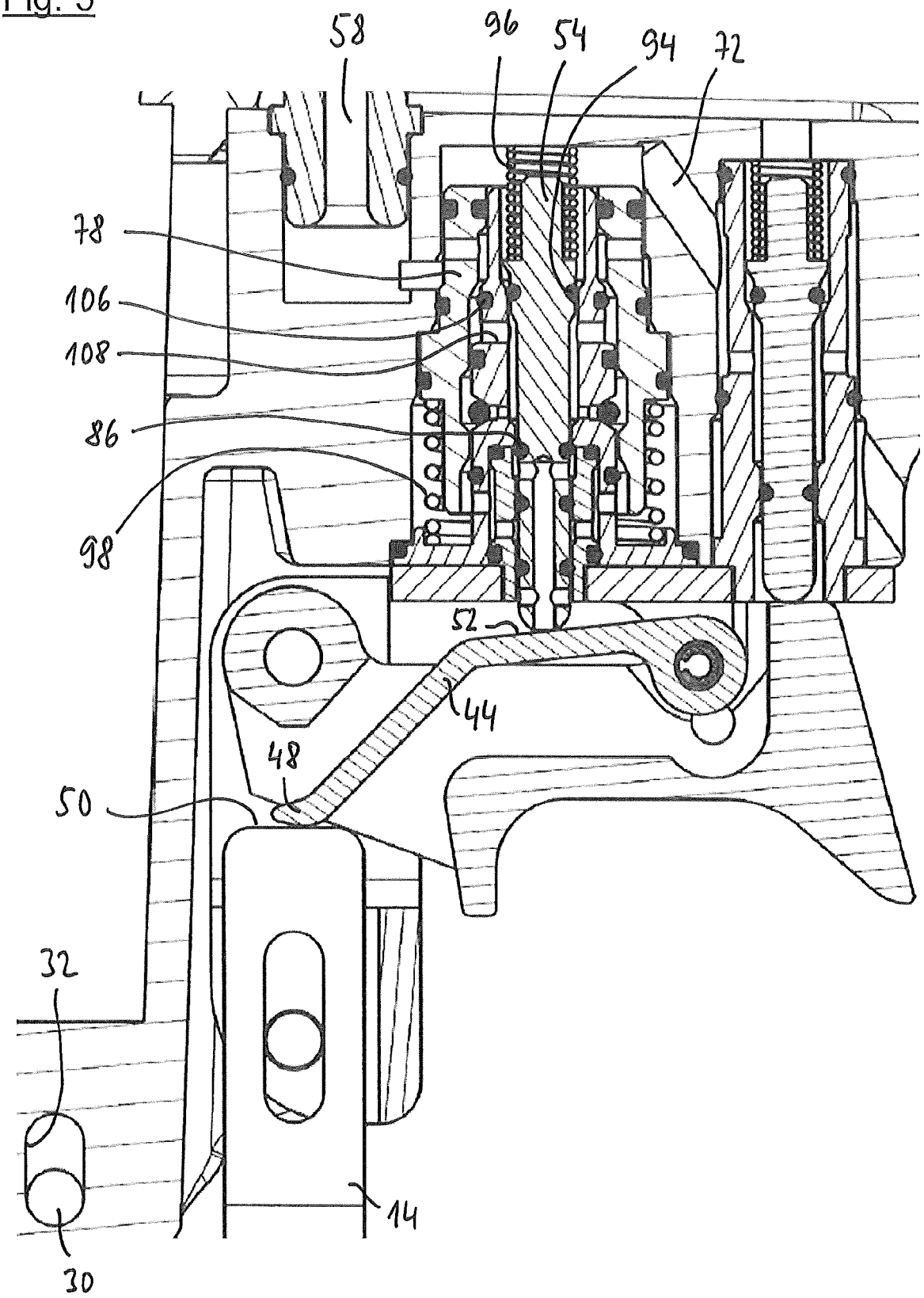

After lifting the pneumatic nailer off the workpiece, the pneumatic nailer quickly reaches the position shown in FIG. 5, in which the contact feeler 14 has already moved a little way down, until the pin 30 rests against the lower end of the slot hole 32 and the effect of the damper 22 begins. The downward movement of the contact feeler 14 is coupled via the lever 44 to a downward movement of the control valve member 54, because the control valve member 54 is in contact with the actuating surface 52 of the lever 44 due to the force exerted by the spring 96 and the free end 48 of the lever 44 is in contact with the upper surface 50 of the contact feeler 14.

At the time shown in FIG. 5 the control valve member 54 has just reached a second switching point at which the fourth O-ring 94 returns to the seal and the third O-ring 86 moves out of the seal. In this way the main control line 58 is shut off from line 72 and, passing the O-ring 106, deaerated through the transverse hole 108, past the third O-ring 86 and through the holes 88, 90, 92 (see FIG. 2) in control valve member 54. The control chamber 98 is still shut off from outside air and remains under pressure so that the safety actuator 78 remains in its trigger position. As a result, contact triggers are possible at any time from the state shown in FIG. 5.

If the pneumatic nailer is not repositioned on the workpiece, the contact feeler 14 continues its downward movement from the position corresponding to the second switching point of the control valve member 54, shown in FIG. 5, under the influence of the damper 22. After a specified time has elapsed, which can range between 1 second and 5 seconds, for example, it reaches the position shown in FIG. 6, which is slightly above its completely unactuated position from FIG. 2.

Figure 6:
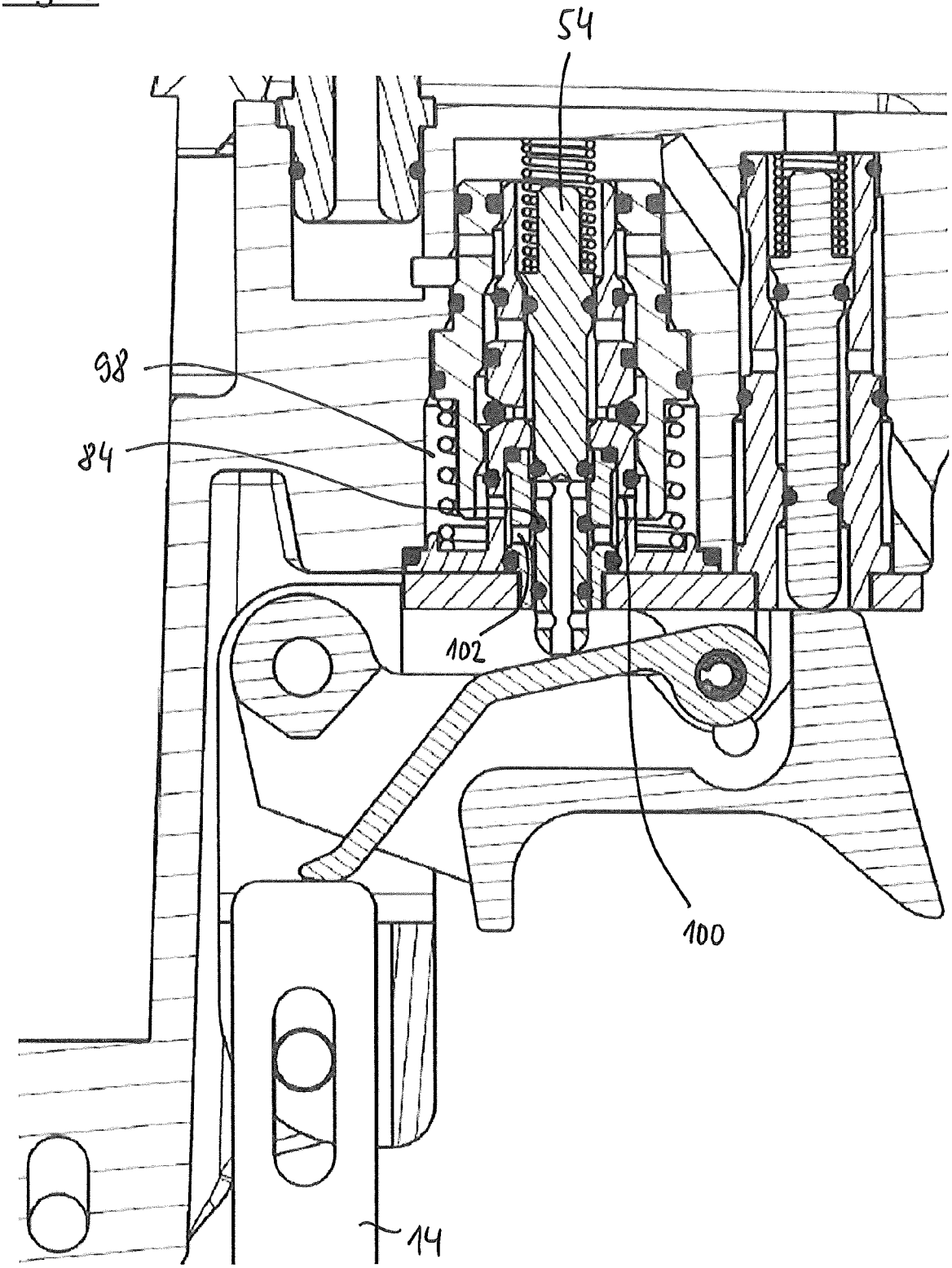

In the position shown in FIG. 6 the control valve member 54, which also moves downwards coupled to the movement of the contact feeler 14, is directly in front of a first switching point. At this first switching point the second O-ring 84 moves out of the seal, which leads to an immediate deaeration of the control chamber 98 via the transverse holes 100 and 102, past the second O-ring 84 and through the holes 88, 90,92 (see FIG. 2).

Figure 7:
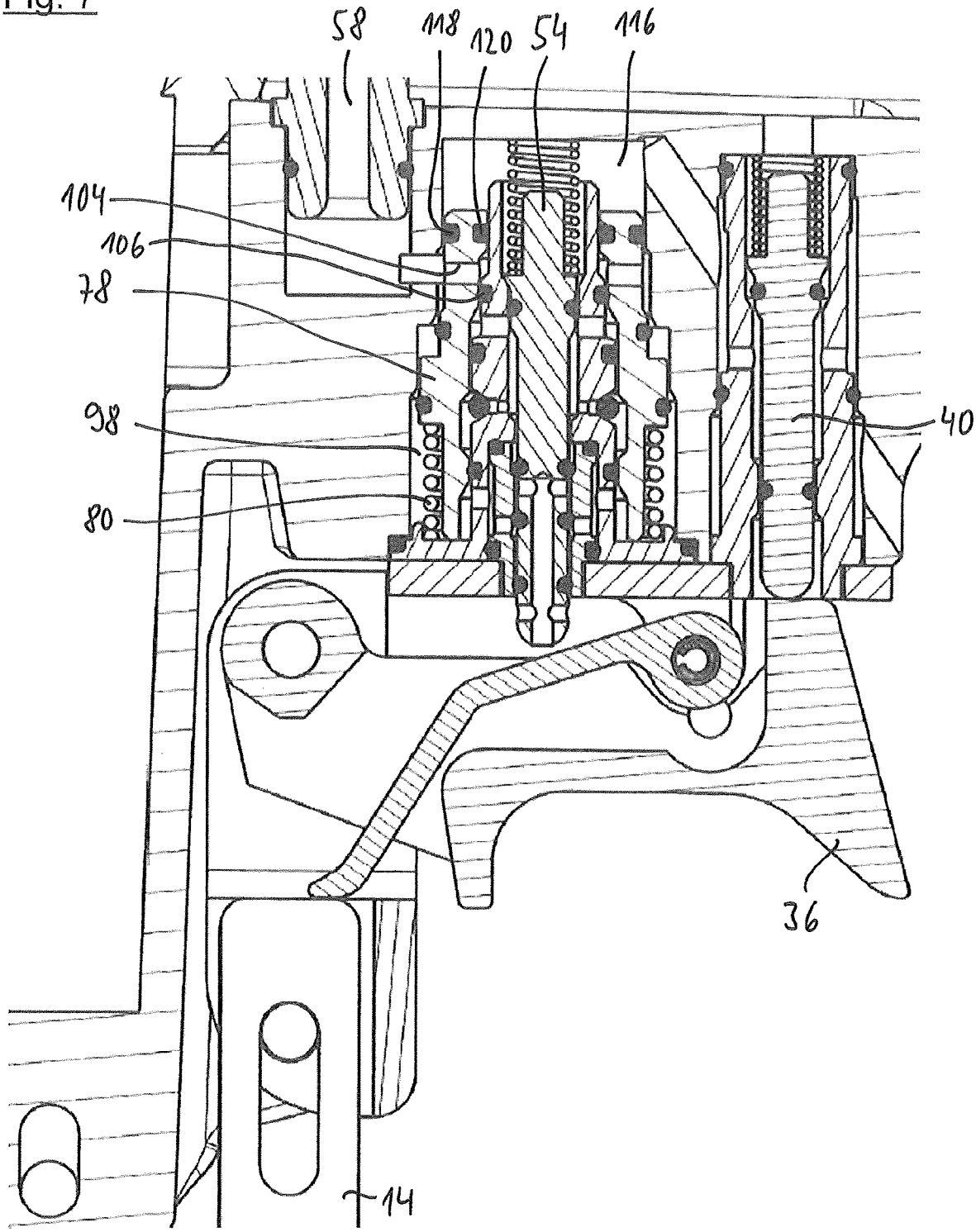

FIG. 7 shows the state of the pneumatic nailer again a short time later. At this point, the contact feeler 14 has reached its completely unactuated position and the control valve member 54 has exceeded the first switching point, so that the control chamber 98 is connected to outside air and no longer exerts any force on the safety actuator 78. The force exerted by the pressure in the space 116 on safety actuator 78 then outweighs the force of spring 80, so that safety actuator 78 has shifted to its lower end position.

This lower end position is a safety position in which no further driving-in processes can be triggered, in particular not by contact triggering by repeated positioning of the pneumatic nailer on a workpiece. The pneumatic nailer is thus in a locked state. This is because, regardless of the position of the valve pin 40 and the control valve member 54, the main control line 58 can no longer be ventilated because the transverse hole 104 is shut off by the O-ring 106 which is now in the seal and the two O-rings 118 and 120 which are always in seal. As an additional safety precaution, O-rings 122, 124 are no longer in seal. Between these O-rings 122, 124 there is a hole not shown which additionally connects the control chamber 98 and the main control line 58 with outside air.

Further triggers are only possible again if trigger 36 is released beforehand. Then the safety actuator 78 returns to its trigger position shown in FIG. 2 and the pneumatic nailer is again in a state ready for triggering.

In addition, FIG. 7 also shows the condition of the pneumatic nailer, which occurs when the trigger 36 is actuated before the contact sensor 14 is actuated. In this case, the safety actuator 78 is moved from the pressure built up in space 116 to its safety position, while the control chamber 98 remains connected to outside air. For this reason, the first driving-in process of the pneumatic nailer described in the example must always be carried out individually.

LIST OF REFERENCES NUMBERS

10 housing
12 handle
14 contact feeler
16 slot hole
18 pin
20 spring
22 damper
24 damper housing
26 damper ram
28 mounting section
30 pin
32 slot hole
34 axis
36 trigger
38 actuation surface
40 valve pin
42 trigger valve
44 lever
46 axis
48 free end
50 upper surface
52 actuating surface
54 control valve member
56 control valve
58 main control line
60 housing interior
62 lower O-ring
64 upper O-ring
66 transverse hole
68 sleeve
70 annular gap
72 line
74 inner sleeve part
76 outer sleeve part
78 safety actuator
80 spring
82 first O-ring
84 second O-ring
86 third O-ring
88 transverse hole
90 transverse hole
92 further transverse hole
94 fourth O-ring
96 spring
98 control chamber
100 transverse hole
102 transverse hole
104 transverse hole
106 O-ring
108 transverse hole
110 transverse hole
112 further O-ring
114 annular gap
116 space
118 O-ring
120 O-ring
122 O-ring
124 O-ring

The invention claimed is:

1. A pneumatic nailer comprising:

a working piston configured for being connected to a driving plunger for driving in a fastener, wherein the working piston is subject to compressed air when a driving-in process is triggered;

a safety device configured to be controlled by pressure in a control chamber, the safety device configured to switch the pneumatic nailer from a trigger-ready state to a locked state;

a control valve configured to control the pressure inside the control chamber, the control valve comprising a control valve member movable along an adjustment path; and a damper coupled to the control valve member.

2. The pneumatic nailer as recited in claim 1, wherein the damper is coupled to the control valve member such that the damper slows down movement of the control valve member along at least one section of the adjustment path.

3. The pneumatic nailer as recited in claim 1, further comprising a triggering device that comprises a contact feeler that is configured to move the control valve member to a fully actuated position when the pneumatic nailer is placed against a workpiece.

4. The pneumatic nailer as recited in claim 1, wherein the control valve member comprises a first switching point at which time the control valve deaerates or aerates the control chamber, and wherein the damper is coupled with the control valve member so that, after removing the pneumatic nailer from the from a workpiece, the control valve member reaches a fully actuated position starting from the first switching point after expiration of a specified period of time.

5. The pneumatic nailer as recited in claim 1, wherein the pneumatic nailer comprises a main control line which must be aerated when a drive-in process is triggered, and wherein the control valve member comprises a second switching point at which time the control valve deaerates the main control line.

6. The pneumatic nailer as recited in claim 1, wherein the pneumatic nailer comprises a main control line which must be deaerated when a drive-in process is triggered, and wherein the control valve member comprises a second switching point at which time the control valve aerates the main control line.

7. The pneumatic nailer as recited in claim 1, wherein the damper is configured to be coupled to the control valve member such that a movement of the control valve member from a fully actuated position to a second switching point is not damped.

8. The pneumatic nailer as recited in claim 1, wherein the damper comprises a slot hole for relieving pressure in the damper, so that a relative movement between two components of the damper are not are not restricted by the damper for a possible range of motion of the damper.

9. The pneumatic nailer as recited in claim 1, wherein a dampening effect by the damper is limited to one of two possible directions of motion of the damper.

10. The pneumatic nailer as recited in claim 1, wherein the damper comprises two elements movable relative to one another, whose relative motion is dampened by the damper, wherein one of the elements is fixed and/or hinged to a part of the pneumatic nailer which is fixed to a housing and the other element is fixed and/or hinged to the: (i) contact feeler, (ii) control valve member, (iii) a force transmission device configured to transmit a force from the contact feeler to the control valve member.

11. The pneumatic nailer as recited in claim 1, wherein the damper is one of a linear damper and a rotary damper.

12. The pneumatic nailer as recited in claim 1, wherein the damper is one of a fluid damper and a friction damper.

13. The pneumatic nailer as recited in claim 3, wherein the safety device comprises a safety actuator which is switchable between an actuatable position, wherein the triggering device can initiate a driving-in process, and a safe position, wherein actuating the triggering device will not initiate a driving-in process since the pressure in the control valve exerts a force on the safety actuator.

14. The pneumatic nailer as recited in claim 13, wherein the safety actuator is moved from an actuatable position to the safety position when the pressure inside the control valve exceeds a predetermined pressure threshold.

* * * * *